US010851322B2

(12) United States Patent
Lee

(10) Patent No.: US 10,851,322 B2
(45) Date of Patent: Dec. 1, 2020

(54) ENGINE OIL ADDITIVE FOR ENHANCING ENGINE FUNCTION AND IMPROVING FUEL EFFICIENCY

(71) Applicants: BEOR ENERGY CO., LTD., Yangju-si (KR); Sang Kuk Lee, Uijeongbu-si (KR); Yongsuk Lee, Pasadena, CA (US)

(72) Inventor: Sang Kuk Lee, Uijeongbu-si (KR)

(73) Assignees: BEOR ENERGY CO., LTD.; Sang Kuk Lee; Yongsuk Lee

( * ) Notice: Subject to any disclaimer, the term of this patent is extended or adjusted under 35 U.S.C. 154(b) by 0 days.

(21) Appl. No.: 16/837,063

(22) Filed: Apr. 1, 2020

(65) Prior Publication Data

US 2020/0248091 A1 Aug. 6, 2020

Related U.S. Application Data

(63) Continuation of application No. PCT/KR2018/007046, filed on Jun. 21, 2018.

(30) Foreign Application Priority Data

Jan. 17, 2018 (KR) ..... 10-2018-0006303

(51) Int. Cl.
*C10M 125/26* (2006.01)
*C10M 169/04* (2006.01)
(Continued)

(52) U.S. Cl.
CPC ..... *C10M 125/26* (2013.01); *C10M 169/04* (2013.01); *C10M 2201/102* (2013.01);
(Continued)

(58) Field of Classification Search
CPC ..... C10M 169/04; C10M 125/26; C10M 2203/003; C10M 2201/102;
(Continued)

(56) References Cited

U.S. PATENT DOCUMENTS 4,909,951 A * 3/1990 Mendelson ..... C10M 169/06 508/175
2011/0257054 A1* 10/2011 Baran, Jr. ..... C10M 141/12 508/139
(Continued)

FOREIGN PATENT DOCUMENTS

JP 07-197048 A 8/1995
JP 2011-105896 A 6/2011
(Continued)

OTHER PUBLICATIONS

Korean Notice of Allowance (KR 10-2018-0006303), KIPO, dated May 15, 2018.
(Continued)

*Primary Examiner* — Vishal V Vasisth
(74) *Attorney, Agent, or Firm* — Park & Associates IP Law, P.C.

(57) ABSTRACT

The present invention provides an engine oil additive for enhancing engine function and improving fuel economy, the additive allowing engine oil particles to be ionized and fragmented by natural minerals simply and inexpensively without a separate device, such that the interval at which the engine oil particles come into contact with the inner wall of an engine decreases and the plasma state is maintained so as to prevent cations and anions from coupling to each other in liquid, and fuel economy is improved while engine activity is enhanced. To this end, the additive is obtained by mixing 1.5-2 wt % of tourmaline, 0.8-1 wt % of sericite, 0.5-0.8 wt % of monazite and 0.3-0.5 of elvan, in a powder form of 2-3 μm into 95.7-96.9 wt % of a base oil so as to be added to an engine oil to be injected into an engine.

2 Claims, 3 Drawing Sheets test article/material/sample name : g-oil2

| test items | | unit | test result | test method |
|---|---|---|---|---|
| oxidation stability (165.5℃, 24h) | viscosity ratio | - | 1.07 | KS M 2021:2007 |
| | increase in total acid number | mg KOH/g | 0.18 | |
| | lacquer level | - | non-adhesion | |
| kinematic viscosity(100℃) | | ㎟/s | 14.43 | KS M ISO 3014:2008 |
| pour point(Air/P) | | ℃ | -44.0 | ASTM D 6749:2002 |
| apparent viscosity at low temperature(-10℃) | | mPa•s | 1 105 | ASTM D 5293:2010$^{e1}$ |
| apparent viscosity at low temperature(-15℃) | | mPa•s | 1 610 | |

(51) Int. Cl.

| | |
|---|---|
| *C10N 30/00* | (2006.01) |
| *C10N 30/12* | (2006.01) |
| *C10N 40/25* | (2006.01) |

(52) U.S. Cl.
CPC ... *C10M 2203/003* (2013.01); *C10N 2030/12* (2013.01); *C10N 2030/54* (2020.05); *C10N 2040/25* (2013.01)
lp;1p

(58) Field of Classification Search
CPC ..... C10M 2201/085; C10M 2205/026; C10N 2040/25; C10N 2020/06; C10N 2030/12; C10N 2030/54; C10N 2030/76
See application file for complete search history.

(56) References Cited

U.S. PATENT DOCUMENTS

| | | | | |
|---|---|---|---|---|
| 2017/0175023 | A1* | 6/2017 | Hasegawa | C08K 3/04 |
| 2017/0349762 | A1* | 12/2017 | Sasaki | C09D 5/02 |

FOREIGN PATENT DOCUMENTS

| | | | |
|---|---|---|---|
| KR | 10-0889941 | B1 | 3/2009 |
| KR | 10-2010-0048621 | A | 5/2010 |
| KR | 10-2010-0060053 | A | 6/2010 |
| KR | 10-1864876 | B1 | 6/2018 |

OTHER PUBLICATIONS

International Search Report (PCT/KR2018/007046), WIPO, dated Feb. 18, 2019.

* cited by examiner test article/material/sample name : g-oil2

| test items | | unit | test result | test method |
|---|---|---|---|---|
| oxidation stability (165.5℃, 24h) | viscosity ratio | - | 1.07 | KS M 2021:2007 |
| | increase in total acid number | mg KOH/g | 0.18 | |
| | lacquer level | - | non-adhesion | |
| kinematic viscosity(100℃) | | ㎟/s | 14.43 | KS M ISO 3014:2008 |
| pour point(Air/P) | | ℃ | -44.0 | ASTM D 6749:2002 |
| apparent viscosity at low temperature(-10℃) | | mPa•s | 1 105 | ASTM D 5293:2010$^{e1}$ |
| apparent viscosity at low temperature(-15℃) | | mPa•s | 1 610 | |

FIG. 1 dynamo test results before injection after injection

| Fueling times (N) | Fuel amount (L) | Driving distance (Km) | Average distance (Km/L) | Advantage (Km) | Remarks |
|---|---|---|---|---|---|
| 1 | 30 | 212 | 7.07 | 12 | *. Average fuel economy of vehicle before additive injection <calculated as 100 km/15L> |
| 2 | 45 | 323 | 7.17 | 23 | |
| 3 | 15 | 107 | 7.13 | 7 | |
| 4 | 45 | 318 | 7.07 | 18 | |
| 5 | 45 | 325 | 7.22 | 25 | |
| 6 | 45 | 323 | 7.18 | 23 | |
| 7 | 45 | 322 | 7.15 | 22 | |
| 8 | 45 | 323 | 7.18 | 23 | |
| 9 | 45 | 310 | 6.89 | 10 | |
| 10 | 15 | 104 | 6.93 | 4 | |
| 11 | 45 | 318 | 7.07 | 18 | |
| 12 | 45 | 317 | 7.04 | 17 | |
| 13 | 45 | 318 | 7.07 | 18 | |
| 14 | 30 | 215 | 7.17 | 15 | |
| 15 | 30 | 214 | 7.13 | 14 | |
| 16 | 45 | 322 | 7.15 | 22 | |
| 17 | 30 | 208 | 6.93 | 8 | |
| 18 | 45 | 328 | 7.29 | 28 | |
| 19 | 45 | 326 | 7.24 | 26 | |
| 20 | 30 | 215 | 7.17 | 15 | |
| 21 | 45 | 317 | 7.04 | 17 | |
| 22 | 45 | 310 | 6.89 | 10 | |
| 23 | 45 | 313 | 6.96 | 13 | |
| 24 | 15 | 105 | 7.00 | 5 | |
| Total | 915 | 6493 | 170.14 | 393 | |
| Average | | | 7.10 | | |

FIG. 3

ENGINE OIL ADDITIVE FOR ENHANCING ENGINE FUNCTION AND IMPROVING FUEL EFFICIENCY

REFERENCE TO RELATED APPLICATIONS

This is a continuation of International Patent Application PCT/KR2018/007046 filed on Jun. 21, 2018, which designates the United States and claims priority of Korean Patent Application No. 10-2018-0006303 filed on Jan. 17, 2018, the entire contents of which are incorporated herein by reference.

FIELD OF THE INVENTION

The present disclosure relates to an engine oil additive. More specifically, the present disclosure relates to an engine oil additive for enhancing engine function and improving fuel efficiency simply and inexpensively in which engine oil particles are ionized by natural minerals and thus are converted into a low molecular weight state which is maintained, thereby to enhance durability of the engine, prevent corrosion inside the engine, and improve combustion function of the engine.

BACKGROUND OF THE INVENTION

An engine oil is used as a lubricant for a vehicle engine to protect the engine against wear, promote engine friction reduction, inhibit sediment formation, improve cleanliness and improve fuel economy. The engine oil improves fuel economy by activating negative charges. Lubrication is minimized to increase energy efficiency. Further, the engine oil maintains safety due to positive charges. The engine oil prevents overload.

For this reason, the engine oil should not carry only negative or positive charges.

That is, balance of the positive and negative charges suppresses generation of harmful substances such as carbon, CO, $CO_2$, $SO_2$, and $NO_2$ due to incomplete combustion of engine fuel, increases fuel efficiency, reduces engine wear, and reduces accumulation of waste products.

However, in liquid, cations and anions tend to return to a stable state via bonding to each other. Thus, it is very difficult to keep amounts of these cations and anions to be balanced while not binding to each other.

When a solid is heated, the solid becomes liquid. When the liquid becomes gas when the liquid is heated. When the gas is heated, electrons absorb too much energy from surroundings, the electrons are removed from an atomic nucleus. Thus, plasma is generated.

That is, atomic nuclei with positive charge (+) and electrons with negative charge (−) are separated from each other to form an ionized state of the plasma which has electrical properties.

The plasma is so common that more than 99% of the universe is in a plasma state. However, the plasma is only limited to lightning or auroras that could be seen naturally on Earth.

However, as research on plasma has been active, the plasma has been applied to various industries. Typical examples thereof include PDP (Plasma Display Panel) televisions that replace conventional CRTs, and LED lights that replace fluorescent lamps. The plasma is mainly applied to improve wear resistance of materials and to prolong their service life via ion implantation into solidified materials such as semiconductors and tempered glass.

In addition, plasma is expected to play a big role in solving various environmental problems. For example, ozone generated from plasma using high-pressure current has excellent ability to decompose odorous components and thus is already used in an air conditioner, air purifier, and deodorant, and is used to reduce exhaust gas in automobiles.

Various carcinogens such as dioxins and harmful gases are emitted from the waste incineration plant. A method of completely decomposing poison gas with a plasma torch is considered as the most ideal waste disposal method. Therefore, when low-temperature plasma may be produced in large quantities at a low cost, this will be able to make a significant contribution to the remedy for environmental problems.

In order to produce the plasma, electric sources such as direct current, ultrahigh frequency, electron beam are applied. Then, the plasma state is maintained using a magnetic field. The plasma thus produced is mainly used to implant ions into the solidified material.

Therefore, it is necessary to apply the plasma to a liquid material such that the binding between negative and positive ions in the liquid in which particles move is suppressed. Further, when this scheme is applied to a liquid engine oil, an additive that functions as the plasma may be added to the engine oil.

SUMMARY OF THE INVENTION

The present disclosure is to meet the above need. A purpose of the present disclosure is to provide engine oil additive for enhancing fuel efficiency and improving engine function, in which the engine oil particles are ionized with natural minerals and thus is converted to a low molecular weight state to narrow spacing between the engine oil particles touching the inner wall of the engine, and a plasma state is maintained so that cations and anions do not bind to each other in the liquid, thereby to improve fuel efficiency while enhancing engine activity.

In addition, the present disclosure is to meet the above need. A purpose of the present disclosure is to provide engine oil additive for enhancing fuel efficiency and improving engine function, in which the engine oil particles are ionized with natural minerals and thus is converted to a low molecular weight state, and, thus, a plasma state is maintained so that cations and anions do not bind to each other therein, simply and inexpensively using the natural minerals without a separate device.

One aspect of the present disclosure provides engine oil additive for enhancing engine function and improving fuel efficiency, the engine oil additive comprising a mixture of base oil 95.7 to 96.9 wt % with tourmaline 1.5 to 2 wt % in 2 to 3 μm powder form, sericite 0.8 to 1 wt % in 2 to 3 μm powder form, monazite 0.5 to 0.8 wt % in 2 to 3 μm powder form, and quartz-porphyry 0.3 to 0.5 wt % in 2 to 3 μm powder form.

In one implementation, the engine oil additive is added to engine oil at a content of 9.5 to 10.5 ml based on 1 L of the engine oil.

According to the engine oil additive for enhancing the engine function and improving fuel efficiency having the above-described technical solution according to the present disclosure, the base oil is mixed with fine powders of tourmaline, sericite, monazite, and quartz-porphyry. Then, the mixture is injected into the engine. Thus, the phenomenon of inducing energy transfer between tourmaline, sericite, monazite, quartz-porphyry to each other is repeated by itself, thereby to achieve the ionization of the engine oil particles in a liquid state having smooth particle activity and to maintain the ionized state, that is, the plasma state, simply and inexpensively. Thus, the low molecular weight state of the engine oil particles is maintained, and the spacing between the engine oil particles contacting the inner wall of the engine is smaller to improve the lubricity of the engine. Thus, the engine operates smoothly, the engine wear is reduced, and the corrosion inside the engine is prevented such that the durability of the engine is improved. Further, the combustion function of the engine is improved, such that the fuel efficiency is increased and carbon dioxide emission is suppressed. This is environmentally friendly.

Further, according to the engine oil additive for enhancing the engine function and improving fuel efficiency having the above-described technical solution according to the present disclosure, the base oil is mixed with fine powders of tourmaline, sericite, monazite, and quartz-porphyry. Then, the mixture is injected into the engine. Thus, the engine oil particles are ionized by the natural minerals and thus are converted into a low molecular weight state, and the plasma state in which the anion and cation are not bound to each other is maintained simply and inexpensively without a separate device.

BRIEF DESCRIPTION OF THE DRAWINGS

FIG. 1 shows test results of characteristics such as oxidation stability of an engine oil additive for enhancing engine function and improving fuel efficiency according to an embodiment of the present disclosure.

FIG. 3 is a table showing fuel efficiency improvement due to the use of an engine oil additive for enhancing engine function and improving fuel efficiency according to an embodiment of the present disclosure.

DETAILED DESCRIPTION OF THE INVENTION

Figure 2:
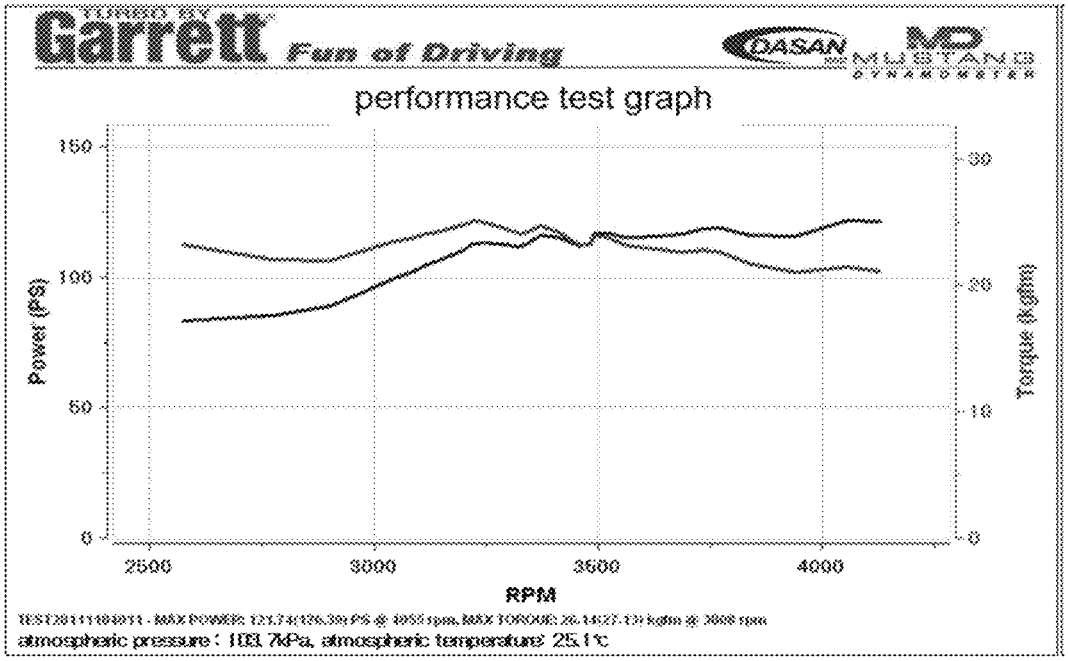
FIG. 2 is a graph showing an increase in engine power due to use of an engine oil additive for enhancing engine function and improving fuel efficiency according to an embodiment of the present disclosure.
Figure 2:
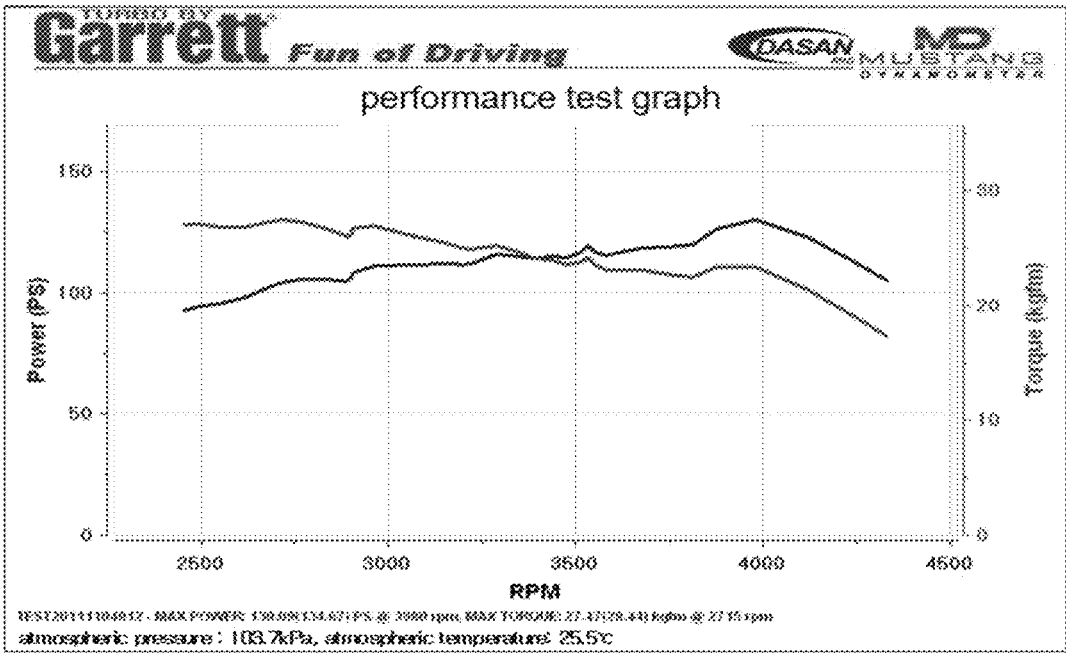

Hereinafter, with reference to the accompanying drawings, preferred embodiments of the present disclosure will be described in detail. The embodiments are intended to allow those skilled in the art to which the present disclosure pertains to easily practice the disclosure. The technical spirit and scope of the present disclosure are limited thereto.

An engine oil additive for enhancing engine function and improving fuel efficiency according to an embodiment of the present disclosure may contain base oil 95.7 to 96.9 wt %, tourmaline 1.5 to 2 wt % for generating electricity via vibration in a powder form of 2 to 3 μm, 0.8 to 1 wt % sericite for generating far infrared rays and negative ions in a powder form of 2 to 3 μm, 0.5 to 0.8 wt % monazite for generating negative ions in a powder form of 2 to 3 μm, and 0.3 to 0.5 wt % quartz-porphyry having high heat amount retention and generating far infrared rays during temperature maintenance in a powder form of 2 to 3 μm.

The base oil refers to a generic concept of lubricant used for lubrication of machinery. The base oil may include mineral base oil, or synthetic base oil such as VHVI (very high viscosity index), PAO (poly alpha olefin), ester, etc. However, the present disclosure is limited thereto. The base oil includes other types of oils which may be the same as the base oil of the engine oil to which the engine oil additive according to an embodiment of the present disclosure is added.

In an embodiment of the present disclosure, the content of the base oil is in a range of 95.7 to 96.9 wt % based on 100 wt % of the engine oil additive. When the content is out of the range, engine oil performance requirement is not met due to over or under-dosing of the natural minerals.

The tourmaline refers to a type of silicate mineral composed of main components of Mg, Fe, B, Si, and Ca having crystals generating electricity. Weak current of 0.06 mA flows constantly in the crystal. When the crystals are crushed to an extremely small size, permanent electrical properties between positive and negative poles as both ends of the crushed crystal are exhibited.

Th tourmaline continues to generate direct current static electricity. Negative ions from the sun are absorbed by a positive electrode of the tourmaline such that the most suitable current for the human body occurs therein, thereby improving health of the human body.

In an embodiment of the present disclosure, the tourmaline ionizes the engine oil particles and stimulates the sericite and monazite for the generation of negative ions. The content of tourmaline is in a range of 1.5 to 2 wt % based on 100 wt % of the engine oil additive.

The sericite belongs to a monoclinic system and refers to fine clay-type muscovite formed by hydrothermal action. A chemical composition thereof is substantially the same as that of muscovite. However, in general, a content of potassium (K) therein is smaller than that in muscovite and has lager moisture content than that in muscovite.

The sericite has various uses due to excellent far-infrared ray and deodorizing effects thereof. The sericite is a clay mineral with great plasticity. The sericite contains $K_2O$ and thus acts as a very useful mineral that serves as a plasticizer and a flux, and is used as raw material for porcelain and a welding rod.

In an embodiment of the present disclosure, the sericite generates far-infrared rays and negative ions to stimulate tourmaline to increase electricity generation and maintain the electricity generation. A content of the sericite is in a range of 0.8 to 1 wt % based on 100 wt % of the engine oil additive.

The monazite refers to a phosphate mineral of a cerium group based rare earth element, and is widely used.

In an embodiment of the present disclosure, the monazite increases the fuel efficiency due to the high amount of anion as generated therefrom, and performs stimulation to tourmaline for further generation of the anions. A content of the monazite is in a range of 0.5 to 0.8 wt % among 100 wt % of the engine oil additive.

The quartz-porphyry is composed mainly of silicic anhydride and aluminum oxide, and has 3 to 150,000 holes per cm3. Thus, the quartz-porphyry has strong adsorption properties. The quartz-porphyry contains about 25,000 inorganic salts. The quartz-porphyry is known to emit far-infrared rays when heat is applied thereto. Thus, the quartz-porphyry has excellent effects in maintaining freshness of food, increasing taste, promoting blood circulation and metabolism due to resonance, and absorption by the far-infrared radiation. Effects of increasing alpha wave and generating far infrared rays using the quartz-porphyry is applied to coating of TV CRT, clothing coating, cell phone coating, etc.

In an embodiment of the present disclosure, the quartz-porphyry has a high heat amount retention and maintains electricity generation from the tourmaline using far infrared rays generated from the quartz-porphyry during temperature maintenance. A content of the quartz-porphyry is in a range of 0.3 to 0.5 wt % among 100 wt % of the engine oil additive.

The contents of 1.5 to 2 wt % of tourmaline, 0.8 to 1 wt % of sericite, 0.5 to 0.8 wt % of monazite, and 0.3 to 0.5 wt % of quartz-porphyry based on the base oil 95.7 to 96.9 wt % are preferable for enhancing engine function and improving fuel efficiency.

The engine oil additive according to an embodiment of the present disclosure may further contain a pigment, a fragrance, etc. if necessary. Further, materials that are commonly used as the engine oil additive may be contained in the engine oil additive according to an embodiment of the present disclosure within a range in which the physical properties of the additive composition is not deteriorated.

The engine oil additive in accordance with the present disclosure is added to target engine oil at a content of 9.5 to 10.5 ml based on 1 L of the engine oil to be injected into the engine. Then, the engine oil is injected into the engine. In one example, the engine oil additive in accordance with the present disclosure is added to target engine oil at a content of 10 ml based on 1 L of the engine oil.

As described above, the engine oil additive in accordance with the present disclosure is added to target engine oil at a content of 9.5 to 10.5 ml based on 1 L of the engine oil to be injected into the engine. Then, the engine oil is injected into the engine. Thus, phenomenon of inducing energy transfer between tourmaline, sericite, monazite, quartz-porphyry to each other is repeated by itself. Thus, particles in the engine oil in a liquid state in which the particles are in an active state are ionized. Thus, a state in which binding between the ionized particles does not occur, that is, the plasma state is maintained, so that a low molecular weight state of the engine oil particles is maintained.

That is, the far infrared rays and anions generated from the sericite enhance vibration of the tourmaline. Then, as the electricity generation from the tourmaline increases, the particles in the engine oil are ionized into cations and anions to lower the molecular weight thereof.

The electricity generated from the tourmaline enhances the generation of negative ions from the sericite and monazite. Then, as the generation of the anion from the monazite increases, the ionized state of the engine oil particles is maintained, so that the state in which the cation and the anion are not bound to each other, but exhibit electrical properties, that is, the plasma state is maintained.

Further, the monazite stimulates the far-infrared ray generation from the sericite. The quartz-porphyry maintains the electricity generation from the tourmaline. Thus, the plasma state in which the ions are not bound to each other but are present in a balanced manner is maintained.

The above processes are repeated by itself.

In this manner, conventional synthesis of chemical materials is not used, but the natural minerals in which semiconductor-like phenomena related to electric charges occur is used. Thus, the natural minerals affect particles within the engine oil inside the engine, resulting in particle ionization of the engine oil, resulting in the low molecular weight state which in turn is maintained. This results in reduced fuel economy, reduced carbon dioxide emissions, enhanced engine lubrication, reduced engine wear and engine coating.

Therefore, mixture of tourmaline, sericite, monazite, and quartz-porphyry with base oil may allow the plasma state to be maintained simply and inexpensively without a separate device.

Example

Polybutene 100 g as the same base oil as the base oil of the engine oil such that the base oil of the engine oil additive has affinity with the engine oil was mixed with tourmaline 2 g for generating electricity via vibration in a powder form of 2 to 3 μm, sericite 1 g for generating far infrared rays and negative ions in a powder form of 2 to 3 μm, monazite 0.6 g for generating negative ions in a powder form of 2 to 3 μm, and quartz-porphyry 0.5 having high heat amount retention and generating far infrared rays during temperature maintenance in a powder form of 2 to 3 μm. Thus, the engine oil additive in accordance with the present disclosure was produced.

The engine oil additive in accordance with the present disclosure is added to target engine oil at a content of 10 ml based on 1 L of the engine oil to be injected into the engine. Then, the engine oil is injected into the engine. In this connection, the base oil of the engine oil is the same as the base oil of the engine oil additive.

FIG. 1 shows test results of characteristics such as oxidation stability of an engine oil additive for enhancing engine function and improving fuel efficiency according to an embodiment of the present disclosure.

The engine oil additive was added to general mineral oil-based engine oil for test. It was conformed that the engine oil having the engine oil additive in accordance with the present disclosure added thereto met specifications for land and marine internal combustion engines, and exhibited oxidation stability higher than that of 100% synthetic engine oil containing PAO or VHVI as the base oil.

FIG. 2 is a graph showing an increase in engine power due to use of an engine oil additive for enhancing engine function and improving fuel efficiency according to an embodiment of the present disclosure.

Further, in order to inject the engine oil having the engine oil additive in accordance with the present disclosure added thereto and verify the improved engine performance, a dynamo test in which a vehicle's drive shaft is driven on a loaded roller, and an actual horsepower and torque of the vehicle is measured was performed.

The engine output increased by 8 horsepower 1 torque from 126 horsepower 26 torque before the injection to 134 horsepower 27 torque after the injection.

FIG. 3 is a table showing fuel efficiency improvement due to the use of an engine oil additive for enhancing engine function and improving fuel efficiency according to an embodiment of the present disclosure.

A vehicle model and model year of the test vehicle were Optima and 2001 model, and a driving distance thereof was 100,000 km. The vehicle was tested at 80 km constant speed and in an economical driving mode. It should be considered that there are some errors because the test was performed in real life.

In addition, an average fuel efficiency of the vehicle before injecting the engine oil additive according to the present disclosure was calculated as 6.6 to 6.7 km/L (100 km/15 L). It was confirmed that the fuel efficiency after the injection of the engine oil additive increased by 6 to 7.6%.

Thus, users confirmed that the vehicle engine was powerful when driving and accelerating the vehicle, the driving distance for the same fuel amount was increased, engine noise was significantly reduced, and idling noise and vibration were greatly reduced.

The present disclosure is not limited to the above embodiments, various modifications are possible within the scope of the disclosure described in the claims, and such modifications are included within the scope of the present disclosure.

What is claimed is:

1. Engine oil additive for enhancing engine function and improving fuel efficiency, the engine oil additive comprising a mixture of base oil 95.7 to 96.9 wt % with tourmaline 1.5 to 2 wt % in 2 to 3 μm powder form, sericite 0.8 to 1 wt % in 2 to 3 μm powder form, monazite 0.5 to 0.8 wt % in 2 to 3 μm powder form, and quartz-porphyry 0.3 to 0.5 wt % in 2 to 3 μm powder form.

2. The engine oil additive of claim 1, wherein the engine oil additive is added to engine oil at a content of 9.5 to 10.5 ml based on 1 L of the engine oil.

* * * * *